US005491858A

United States Patent [19]

Massotte et al.

[11] Patent Number: 5,491,858

[45] Date of Patent: Feb. 20, 1996

[54] METHOD AND MACHINE FOR CONTINUOUSLY DYEING TEXTILE YARNS

[75] Inventors: Philippe Massotte, Wintzenheim; Hubert Tretsch, Brunstatt, both of France

[73] Assignee: Superba, Mulhouse, France

[21] Appl. No.: 85,086

[22] Filed: Jul. 2, 1993

[30] Foreign Application Priority Data

Jul. 8, 1992 [FR] France ..... 92 08455

[51] Int. Cl.[6] ..... D06B 1/02

[52] U.S. Cl. ..... 8/151.2; 68/205 R; 68/13 R

[58] Field of Search ..... 8/149, 151.2; 68/205 R, 68/13, 200, 203, 65, 148; 239/97, 240, 243, 380; 118/323, 324, 325, 314; 134/61

[56] References Cited

U.S. PATENT DOCUMENTS

| | | | |
|---|---|---|---|
| 2,894,485 | 7/1959 | Sedlacsik, Jr. | 118/314 |
| 3,227,077 | 1/1966 | Farrer et al. | 68/203 |
| 3,304,862 | 2/1967 | Lawrence et al. | 68/203 |
| 3,775,054 | 11/1973 | DeVinney | 8/149 |
| 3,783,654 | 1/1974 | Crawford | 8/149 X |
| 3,871,196 | 3/1975 | Matsunaga | 68/203 |
| 3,879,966 | 4/1975 | Klorth et al. | 68/203 |
| 4,047,271 | 9/1977 | Paterson et al. | 8/149 |
| 4,116,626 | 9/1978 | Varner | 8/149 |
| 4,153,961 | 5/1979 | Cleveland . | |
| 4,338,876 | 7/1982 | Norton | 118/314 |
| 4,432,217 | 2/1984 | Ochsner | 68/203 |
| 4,984,169 | 1/1991 | Johnson, Jr. | 8/149 |
| 5,142,481 | 8/1992 | Cox | 8/199 |

FOREIGN PATENT DOCUMENTS

| | | | |
|---|---|---|---|
| 138138 | 4/1985 | European Pat. Off. | 8/149 |
| 2215804 | 8/1974 | France . | |
| 2226819 | 11/1974 | France . | |
| 22749 | 3/1973 | Luxembourg . | |
| 1009584 | 11/1965 | United Kingdom | 118/325 |

OTHER PUBLICATIONS

"Space–Dyeing Verfahren", *Melliand Textilberichte*, vol. 54, No. 6, Jun. 1973, pp. 646–649.

*Primary Examiner*—Frankie L. Stinson
*Attorney, Agent, or Firm*—Young & Thompson

[57] ABSTRACT

In a method for continuously dyeing textile yarns (14), the yarns travel continuously in front of a succession of stations (15*a*, 15*b*, 15*c*) for applying dyes of different colors, each station applying a series of spots onto the yarns (14), so that each yarn includes a succession of spots forming a pattern extending over a certain length (L) of the yarn (14) and which is continuously repeated. The stations (15*a*, 15*b*, 15*c*) for applying the dye are commanded individually in order to corrupt the repetitiveness of the successive patterns. The method is useful for improving the quality of carpets obtained from textile yarns (14).

20 Claims, 6 Drawing Sheets

METHOD AND MACHINE FOR CONTINUOUSLY DYEING TEXTILE YARNS

FIELD OF THE INVENTION

The present invention relates to a method and a machine for continuously dyeing textile yarns.

PRIOR ART

The Applicant Company described, in its French Patent 89 10277 of 26 Jul. 1989, a machine for continuously dyeing textile yarns, in which these yarns travel continuously in front of a succession of stations for applying dyes of different colors, each station applying a succession of spots onto the yarns, so that each yarn includes a succession of spots forming a pattern extending over a certain length of the yarn and which is continually repeated.

In this machine, each application station comprises a dye-spraying turbine rotationally driven about an axis which is parallel to the direction of travel of the yarns, each turbine having several holes for the passage of the dye which are suitable for spraying a succession of spots onto the yarns.

In this embodiment, the set of turbines is connected by a common shaft driven by a single electric motor, so that all the turbines rotate at the same speed.

There is thus obtained on the yarns a succession of spots with a given order of colors, forming a pattern extending over a certain length of yarn and which repeats indefinitely and perfectly.

The textile yarns thus obtained are used particularly for manufacturing carpets.

The Applicant Company noticed that the perfect repetition of the aforementioned pattern of spots on the yarns was manifested by the presence on the carpets of defects in the form of strips affecting the quality of these carpets.

The object of the present invention is to overcome this drawback.

SUMMARY OF THE INVENTION

The present invention thus relates to a method for continuously dyeing textile yarns, in which these yarns travel continuously in front of a succession of stations for applying dyes of different colors, each station applying a series of spots onto the yarns, so that each yarn includes a succession of spots forming a pattern extending over a certain length of the yarn and which is continually repeated.

According to the invention, this method is one wherein the stations for applying the dye are commanded individually in order to corrupt the repetitiveness of the successive patterns.

This method thus makes it possible to eliminate the defects discussed earlier.

According to a first version of the method, the stations for applying the dye are commanded individually in order to modify the length of the successive patterns.

Thus, the length of the successive patterns will vary slightly from one pattern to another.

This result may be obtained by adjusting the rotational speed of electric motors individually driving the turbines for spraying the dye.

According to a second version of the method, the stations for applying the dye are commanded individually in order to modify the order of the colors of the spots in the successive patterns.

This measure, combined with the previous one, makes it possible to corrupt the repetitive nature of the pattern of the spots of color still further.

This result, like the previous one, may be obtained by commanding sudden variations in the rotational speed of the motors driving the turbines.

According to a third version of the method, the stations for applying the dye are commanded individually in order to form successive patterns which are different from one another owing to the presence or absence of a spot of given color.

According to another aspect of the invention, the machine for continuously dyeing textile yarns comprises a succession of stations for applying dyes of different colors, means for making the textile yarns travel continuously in front of the said application stations, each application station comprising a dye-spraying turbine driven rotationally about an axis which is parallel to the direction of travel of the yarns, each turbine having several holes for the passage of the dye which are suitable for spraying a succession of spots onto the yarns, the set of application stations being suitable for forming on the yarns a pattern of spots extending over a certain length of yarn.

According to the invention, this machine is one wherein the application stations comprise individual command means making it possible to corrupt the perfect repetitiveness of the successive patterns.

Other features and advantages of the invention will emerge further in the following description.

BRIEF DESCRIPTION OF THE DRAWINGS

In the appended drawings given by way of non-limiting examples.

DESCRIPTION OF THE PREFERRED EMBODIMENTS

Figure 1:
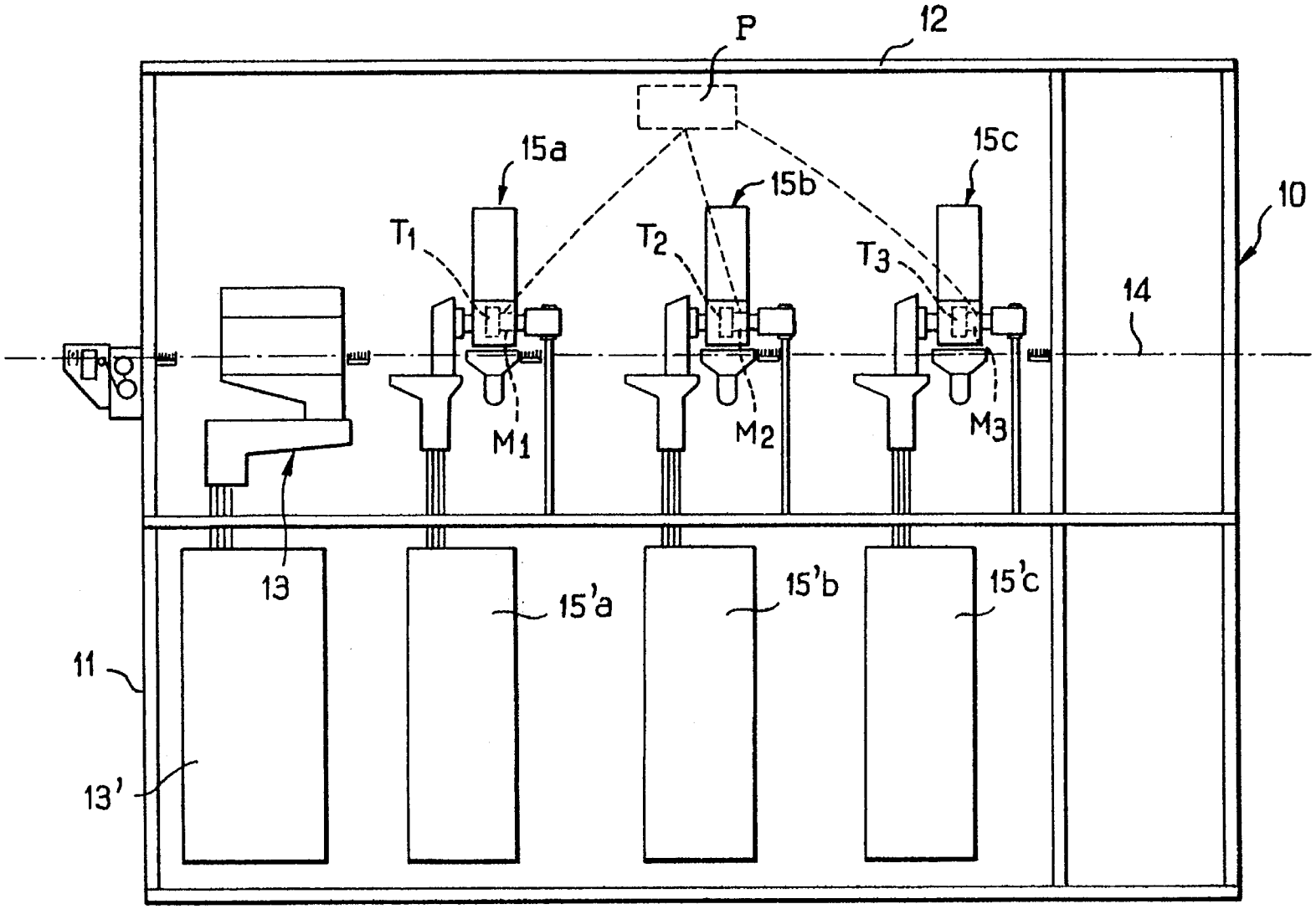
FIG. 1 is a diagrammatic front view of a continuous dyeing machine according to the invention.

Referring to FIG. 1, the machine 10 for continuously dyeing textile yarns includes a frame 11 capped by a casing 12 inside which there is mounted a device 13 for applying a plain dye to a lap of yarns 14, and three stations 15*a*, 15*b*, 15*c* comprising dyeing turbines $T_1$, $T_2$, $T_3$ intended to apply discontinuous spots of dyes which are generally not superimposed. It is clearly understood that the number of dyeing turbines intended to apply spots may be other than three, depending on the results which it is desired to obtain. A reservoir of plain dye 13' is associated with the application device 13, and the reservoirs 15'*a*, 15'*b* and 15'*c* are associated with the stations for depositing colored spots.

Such a machine has been described in detail in French Patent 89 10277 in the name of the Applicant Company. Consequently, only the modifications made to this machine will be described in detail here.

Figure 2:
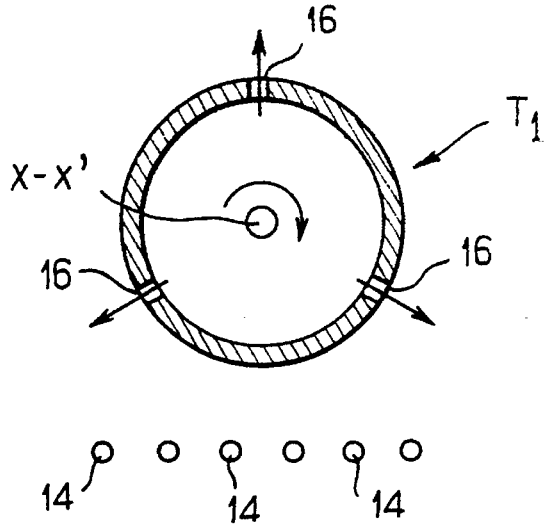
FIG. 2 is a sectional view of a turbine of the machine according to the invention.

FIG. 2 represents one of the dye-spraying turbines $T_1$, rotationally driven about an axis X-X' which is parallel to the direction of travel of the yarns 14. The turbine $T_1$ includes, in the example shown, at its periphery, three holes 16 for the passage of the dye. These holes 16 are suitable for spraying a succession of three spots $A_1$, $A_2$, $A_3$, which are spaced apart and of the same color, onto the yarns 14, as indicated in FIG. 3.

Figure 3:
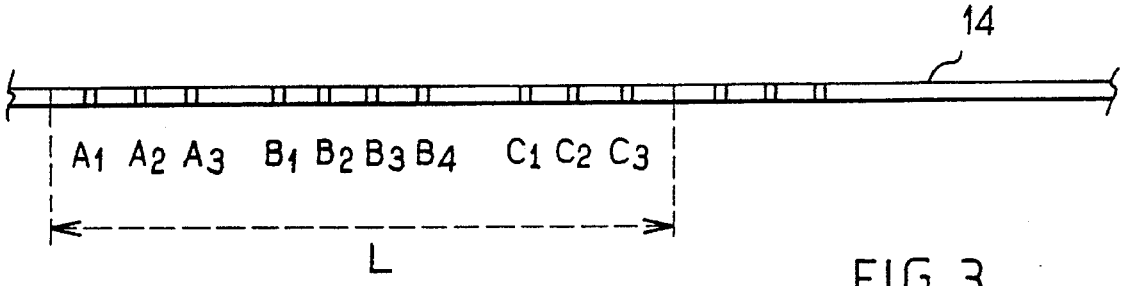
FIG. 3 is a view of a textile yarn including a series of colored spots obtained by means of a machine in accordance with the invention.

In the example of FIG. 3, the turbine $T_2$ sprays four spots $B_1$, $B_2$, $B_3$, $B_4$ of a different color from that of the spots $A_1$, $A_2$, $A_3$ onto the yarn 14.

Likewise, the third turbine $T_3$ sprays three spots $C_1$, $C_2$, $C_3$ onto the yarn.

The three turbines $T_1$, $T_2$, $T_3$ thus form, on the yarn 14, a pattern of spots extending over a length L of the yarn which depends on the speed of travel of this yarn.

When the three turbines $T_1$, $T_2$, $T_3$ rotate at the same speed, as envisaged in the machine described in French Patent 89 10277, the pattern of length L repeats indefinitely with perfect regularity.

In accordance with the invention, the application stations 15*a*, 15*b*, 15*c* of the machine represented in FIG. 1 comprise individual command means making it possible to corrupt the perfect repetitiveness of the successive-patterns.

In the example represented in FIG. 1, the turbines $T_1$, $T_2$, $T_3$ are each rotationally driven by an electric motor $M_1$, $M_2$, $M_3$. The rotational speed of each of these motors may be adjusted independently of that of the other motors.

It is thus possible to modify, in a predetermined manner, the length L of the successive patterns so as to corrupt the repetitiveness of the latter.

The speed of the motors $M_1$, $M_2$, $M_3$ may consequently be programmed so that the length of the second pattern is longer or shorter than that of the first pattern, and so on.

Figure 4:
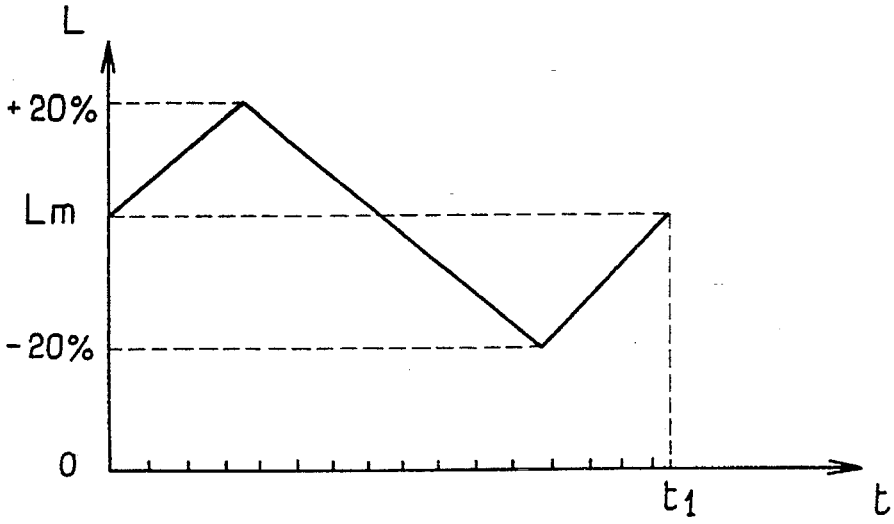
FIG. 4 is a diagram illustrating a first version of the invention and representing the variation in length of a pattern of a succession of spots as a function of time.

FIG. 4 represents, by way of example, the variation as a function of time t of the length L of the successive patterns which is obtained by uniformly varying the rotational speed of the turbines $T_1$, $T_2$, $T_3$.

1) In this example, the length increases from a mean value $L_m$ up to a maximum value equal to +20% of the value $L_m$, then decreases down to a minimum value equal to −20% of the value $L_m$, then rises again up to the mean value $L_m$.

The duration $t_1$ of the cycle represented in FIG. 4 corresponds to a large number of successive patterns.

This duration will be chosen depending on the desired result.

The variation in rotational speeds of the motors $M_1$, $M_2$, $M_3$ driving the turbines may be commanded by a computer P (see FIG. 1) preprogrammed in a suitable manner.

Figure 5:
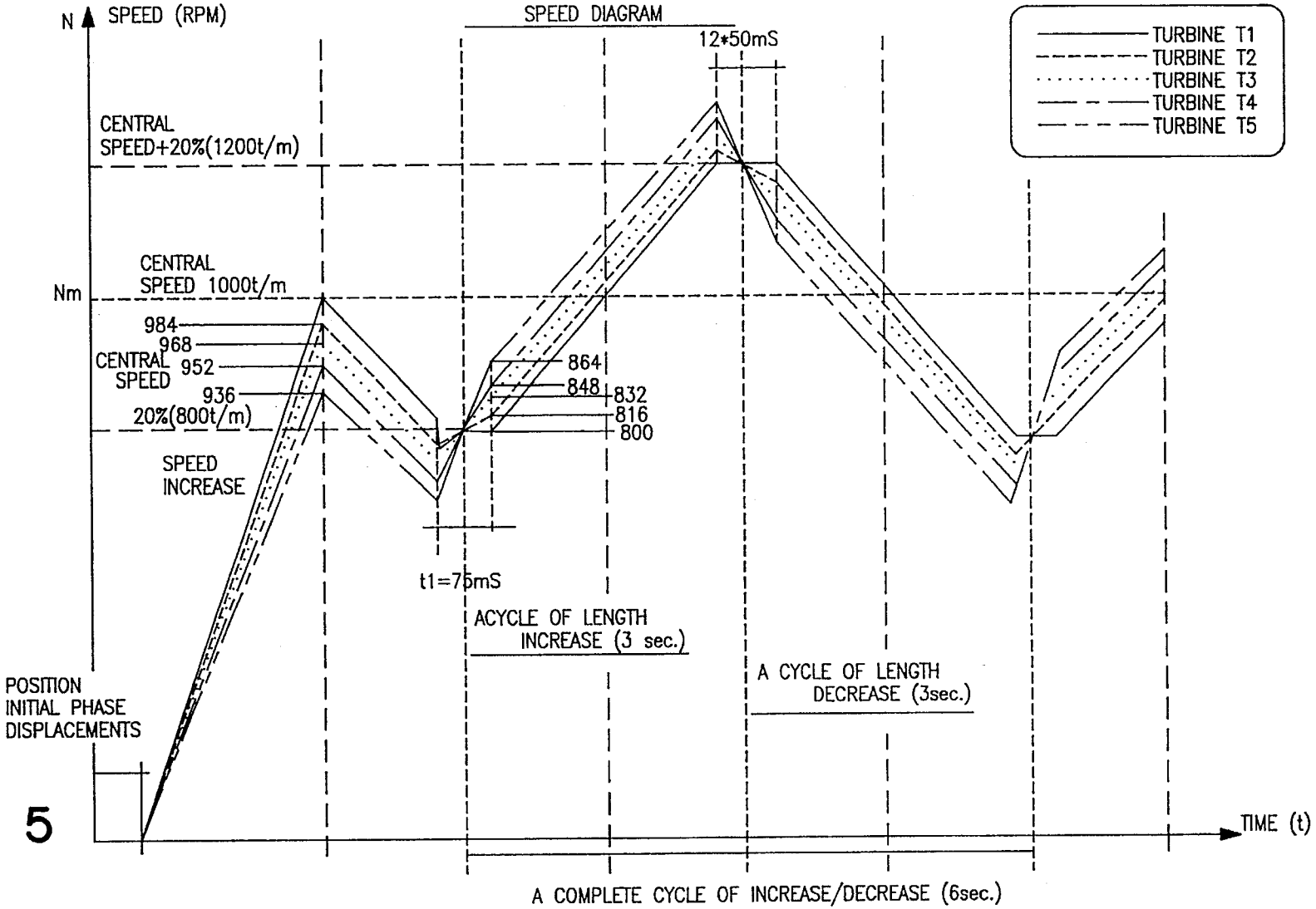
FIG. 5 is a diagram also illustrating the first version of the invention and representing the variation in the rotational speed of the turbines as a function of time.

2) FIG. 5 illustrates the chart of the variation in rotational speed N as a function of time t, for the turbines $T_1$, $T_2$, $T_3$, . . . , which must be adopted when it is desired to obtain this nonrepetitive nature of the successive patterns.

The speed N of the motor of the turbines $T_1$, $T_2$, $T_3$, . . . varies by plus or minus 20% about a mean value Nm, and this speed is different, at a given moment, for the different turbines.

The initial phase shift between the turbines is thus preserved, which makes it possible to avoid superposition of the spots.

In the case represented, the speed of the turbines $T_2$, $T_3$ is, at a given moment, slightly less than that of the turbine $T_1$, for example by 20 rpm.

Figure 6:
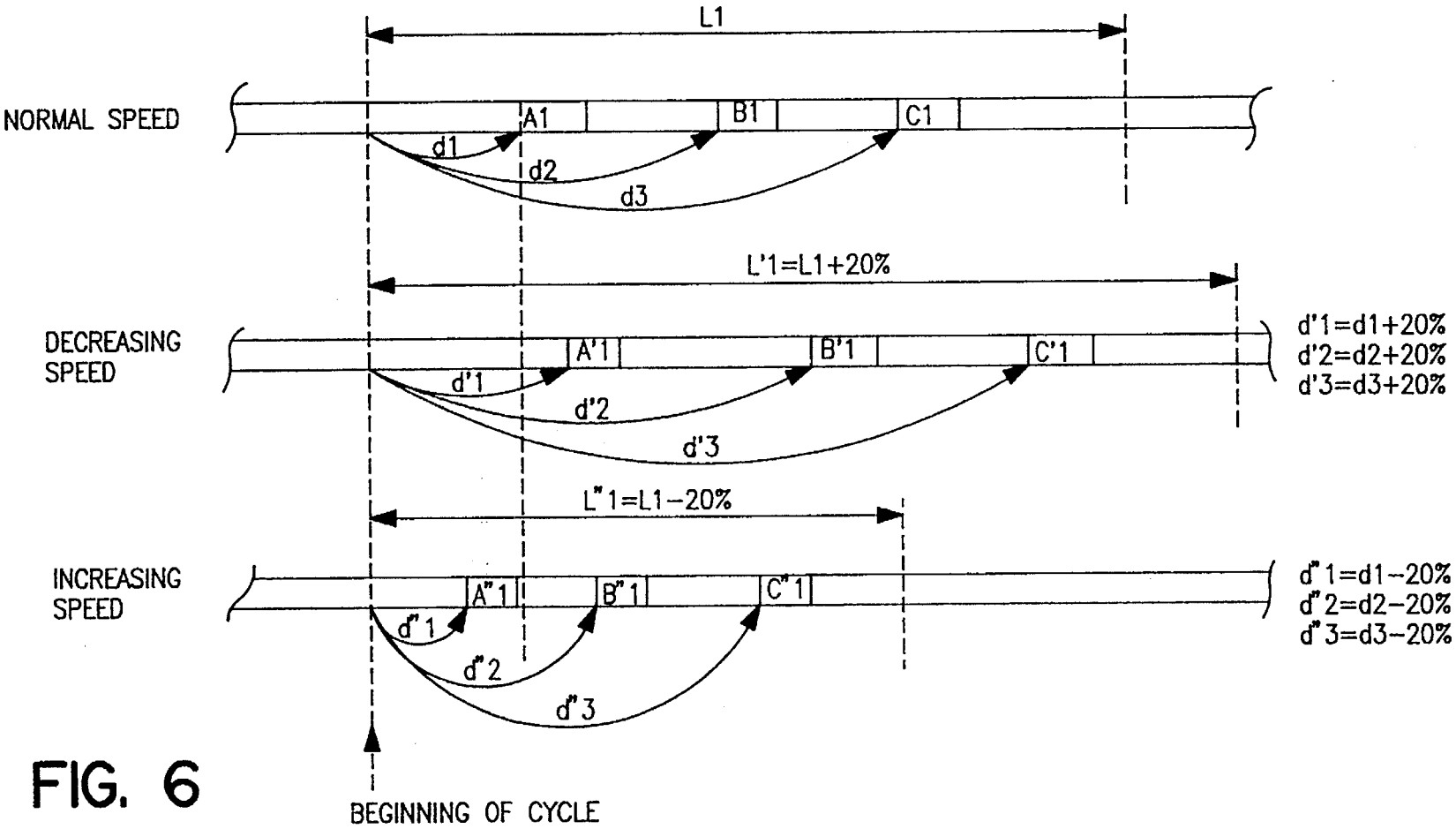
FIG. 6 is a view of the textile yarn obtained after implementing the version illustrated in FIG. 5.

FIG. 6 shows the result obtained.

The top diagram shows the succession of the spots $A_1$, $B_1$, $C_1$ which are obtained during a first cycle, with the turbines rotating at nominal speed.

The middle diagram shows the succession of spots $A'_1$, $B'_1$, $C'_1$ during a second cycle, with the turbines rotating at a reduced speed.

The bottom diagram shows the succession of spots $A''_1$, $B''_1$, $C''_1$ during a third cycle in which the turbines rotate at an increased speed.

Figure 7A:
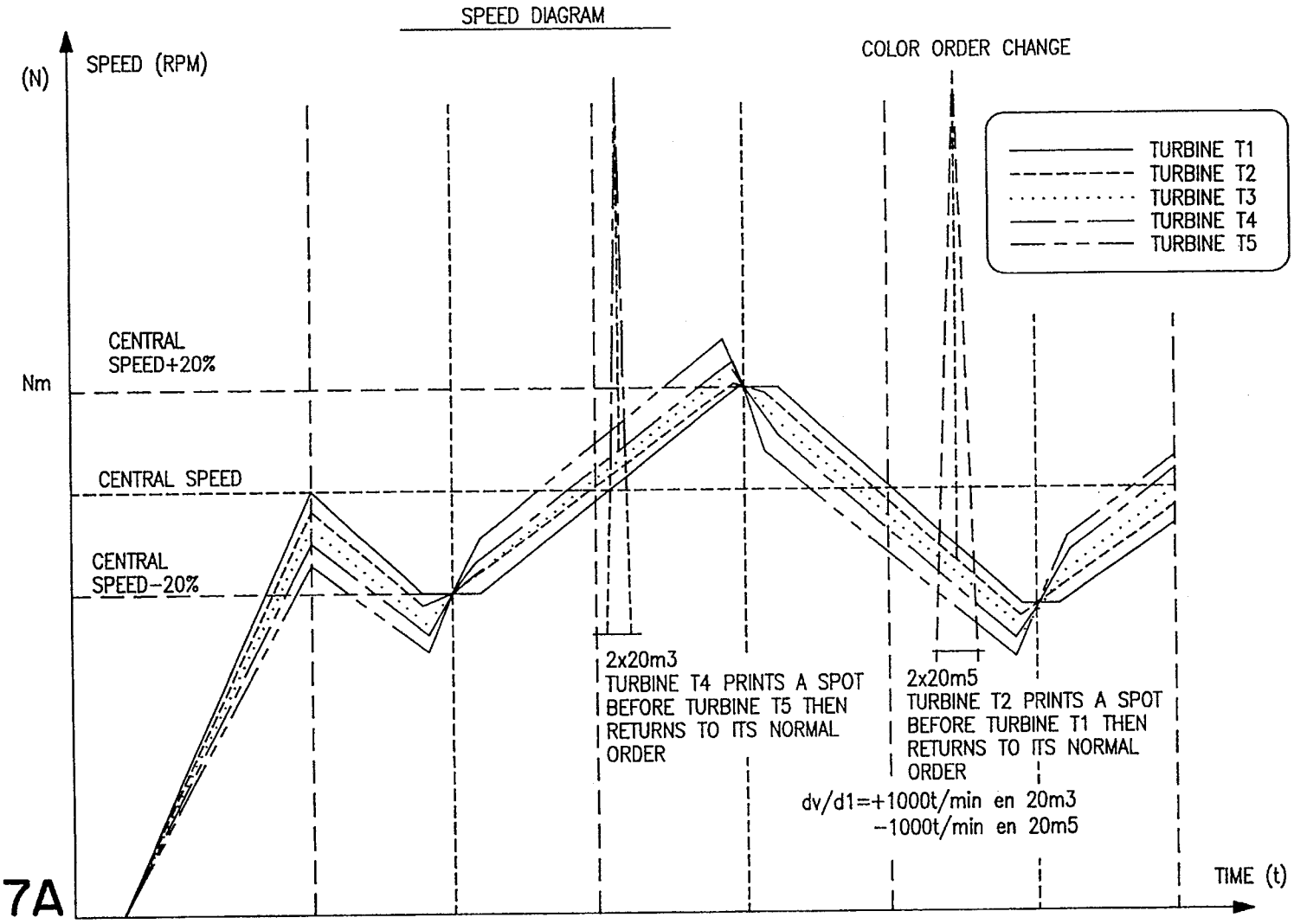
FIG. 7A is the chart of the rotational speeds of the turbines when implementing the second version of the invention combined with the first version.
Figure 7:
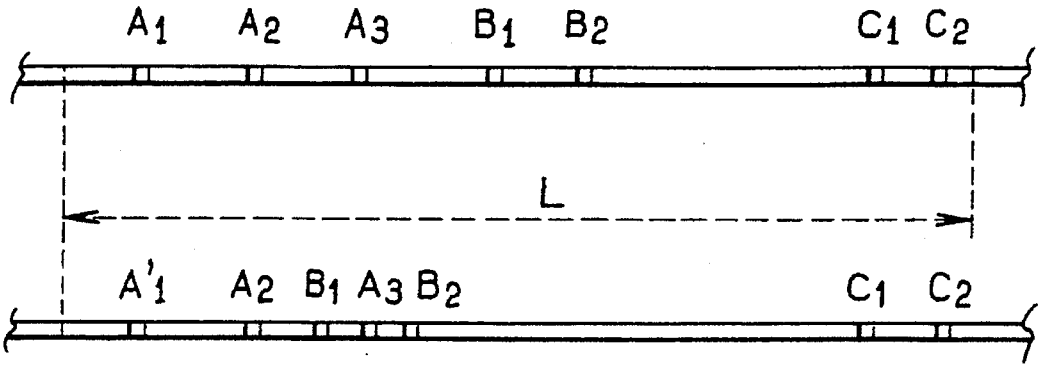
FIG. 7 is a view of the textile yarn obtained after implementing a second version of the invention.

According to the second version of the invention, illustrated by FIG. 7, the adjustment of the speeds of the turbines is such that the order of the colors of the spots in the successive patterns is modified by abruptly accelerating or decelerating the speed of one of the turbines.

In the example of FIG. 7, the first pattern (at the top of the figure) comprises a normal succession of spots $A_1$, $A_2$, $A_3$ (turbine $T_1$), $B_1$, $B_2$ (turbine $T_2$) and $C_1$, $C_2$ (turbine $T_3$).

In the second pattern (at the bottom of the figure), the rotational speed of the turbine $T_2$ has been accelerated so that the first spot $B_1$ sprayed by the turbine $T_2$ becomes interposed in the succession of spots $A_1$, $A_2$, $A_3$ sprayed by the turbine $T_1$.

This version of the method may be combined with the previously-described version so as to increase still further the nonrepetitive nature of the successive patterns. The chart of FIG. 7A illustrates this combination.

In a third version of the invention, each turbine $T_1$, $T_2$, $T_3$ is associated with a command means for stopping or restarting the spraying of the spots onto the yarns 14. These means may consist of stoppers commanded, for example, by electromagnets.

Successive patterns which differ from one another may thus be formed on the yarns 14 by means of the presence or absence of a spot of given color.

Figure 8:
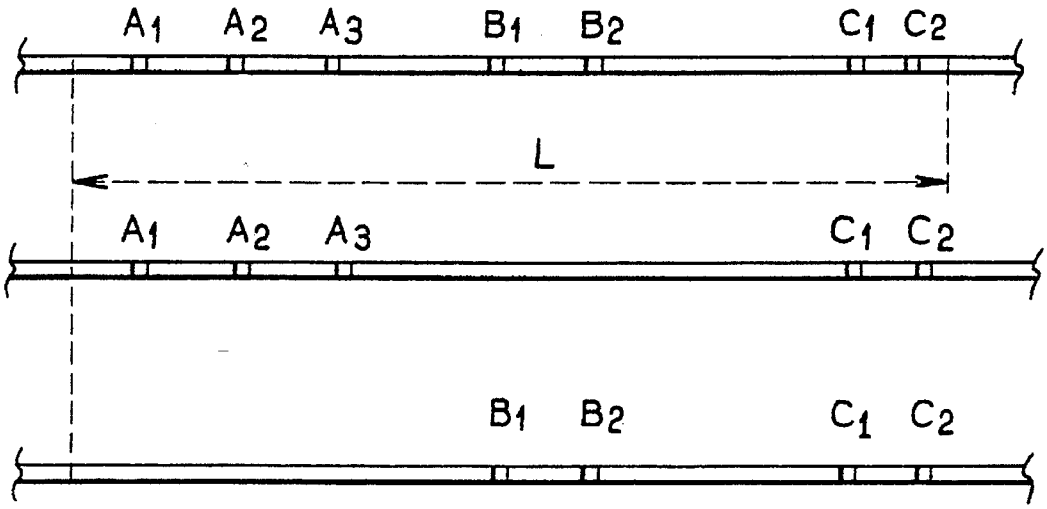
FIG. 8 is a view of the textile yarn obtained after implementing a third version of the invention.

This variant of the method according to the invention is illustrated in FIG. 8.

In this example, the first pattern (top of FIG. 8) comprises a normal succession of spots $A_1$, $A_2$, $A_3$ (turbine $T_1$), $B_1$, $B_2$ (turbine $T_2$) and $C_1$, $C_2$ (turbine $T_3$).

In the second pattern, the stopper associated with the turbine $T_2$ has been closed, which is manifested by the absence of the spots $B_1$, $B_2$.

In the second pattern (at the bottom of FIG. 8) the stopper of the turbine $T_1$ has been closed, which is manifested by the absence of the spots $A_1$, $A_2$, $A_3$.

This variant of the method according to the invention may be combined with one or other of the previous versions in order to corrupt the repetitive nature of the successive patterns to a greater or lesser extent depending on the quality of the final product which it is desired to obtain.

The versions of the method implemented by varying the speed of the turbines require very precise means for adjusting the speed of the motors.

The electric motors used must be of the brushless type and have low inertia so that their rotational speeds can change for example from 0 to 4000 rpm in a fraction of a second.

The electronic command circuit controlled by a computer must additionally be capable of very precisely adjusting the rotational speed of the various motors.

Of course, the invention is not limited to the examples which have just been described and numerous modifications may be made to it without departing from the scope of the invention.

Thus, modification of the shape of the spots in the successive patterns could be envisaged.

We claim:

1. A method for continuously dyeing textile yarns (14), in which the yarns travel continuously in front of a succession of stations (15*a*, 15*b*, 15*c*) for applying dyes of different colors, each station applying a series of spots ($A_1$, . . . $B_1$, . . . $C_1$, . . . ) onto the yarns (14) by means of a dye-spraying turbine (T1, T2, T3) driven rotationally by a drive motor (M1, M2, M3) about an axis which is parallel to the direction of travel of the yarns (14), so that each yarn includes a succession of spots forming a pattern extending over a certain length (L) of the yarn (14) and which is continually repeated, wherein the rotational speed (N) of the drive motor (M1, M2, M3) of each dye-spraying turbine (T1, T2, T3) is adjusted individually and independently of that of the other motors in order to corrupt the repetitiveness of the successive patterns and to avoid superposition of the spots.

2. The method as claimed in claim 1, wherein the rotational speed (N) of the drive motor (M1, M2, M3) of each dye-spraying turbine is adjusted individually in order to modify the length (L) of the successive patterns.

3. The method as claimed in claim 1, wherein the rotational speed (N) of the drive motor (M1, M2, M3) of each dye-spraying turbine is adjusted individually in order to modify the order of the colors of the spots ($A_1$, . . . $B_1$, . . . $C_1$, . . . ) in the successive patterns.

4. The method as claimed in claim 1, wherein the rotational speed (N) of the drive motor (M1, M2, M3) of each dye-spraying turbine is adjusted individually in order to form successive patterns which are different from one another owing to the presence or absence of a spot of given color.

5. A machine for continuously dyeing textile yarns (14) comprising a succession of stations (15*a*, 15*b*, 15*c*) for applying dyes of different colors, means for making the textile yarns (14) travel continuously in front of said application stations (15*a*, 15*b*, 15*c*), each application station comprising a dye-spraying turbine (T1, T2, T3) driven rotationally by a drive motor (M1, M2., M3) about an axis which is parallel to the direction of travel of the yarns (14), each turbine having at its periphery several holes (16) for the passage of the dye which are suitable for spraying a succession of spots ($A_1$, . . . $B_1$, . . . $C_1$, . . . ) onto the yarns (14), the succession of application stations (15*a*, 15*b*, 15*c*) being adapted to form on each yarn a pattern of spots extending over a certain length (L) of the yarn (14) and which is continually repeated, wherein the application stations (15*a*, 15*b*, 15*c*) comprise means for individually adjusting the rotational speed (N) of the drive motor (M1, M2, M3) of each dye-spraying turbine (T1, T2, T3) and independently of that of the other motors in order to corrupt the repetitiveness of the successive patterns.

6. The machine as claimed in claim 5, wherein said means for adjusting the speed (N) are suitable for varying the length (L) of the successive patterns, so that, in a series of successive patterns, their length varies continuously up to + or −20% of their mean length ($L_m$).

7. The machine as claimed in claim 6, wherein said means for adjusting the speed (N) are further suitable for maintaining a certain offset between the rotational speeds of the turbines (T1, T2, T3) provided in the successive application stations.

8. The machine as claimed in claim 6, wherein said means for adjusting the speed (N) are suitable for accelerating or decelerating the rotational speed of a turbine (T1, T2, T3) of a given station so as to modify the order of the colors of the spots in the successive patterns.

9. The machine as claimed in claim 5, wherein each turbine (T1) is associated with a command means for stopping or starting the spraying of spots onto the yarns (14).

10. The machine as claimed in claim 9, wherein said means are suitable for forming successive patterns which are different from one another owing to the presence or absence of a spot of given color.

11. The machine as claimed in claim 5, wherein the motors ($M_1$, $M_2$, $M_3$) for driving the turbines ($T_1$, $T_2$, $T_3$) are brushless electric motors commanded by an electronic circuit controlled by a computer (P) suitable for varying their rotational speed according to a predetermined program.

12. A method for continuously dyeing textile yarns (14), in which the yarns travel continuously in front of a succession of stations (15*a*, 15*b*, 15*c*) for applying dyes of different colors, each station applying a series of spots ($A_1$, . . . $B_1$, . . . $C_1$, . . . ) onto the yarns (14) by means of a dye-spraying turbine (T1, T2, T3) driven rotationally by a drive motor (M1, M2, M3) about an axis which is parallel to the direction of travel of the yarns (14), so that each yarn includes a succession of spots forming a pattern extending over a certain length (L) of the yarn (14) and which is continually repeated, wherein the rotational speed (N) of the drive motor (M1, M2, M3 ) of each dye-spraying turbine (T1, T2, T3) is adjusted individually and independently of that of the other motors, in order to corrupt the repetitiveness of the successive patterns, and to modify the colors of the spots ($A_1$, . . . $B_1$, . . . $C_1$, . . . ) in the successive patterns.

13. The method as claimed in claim 12, wherein the rotational speed (N) of the drive motor (M1, M2, M3) of each dye-spraying turbine is adjusted individually in order to modify the length (L) of the successive patterns.

14. The method as claimed in claim 12, wherein the rotational speed (N) of the drive motor (M1, M2, M3) of each dye-spraying turbine is adjusted individually in order to form successive patterns which are different from one another owing to the presence or absence of a spot of given color.

15. A machine for continuously dyeing textile yarns (14) comprising a succession of stations (15*a*, 15*b*, 15*c*) for applying dyes of different colors, means for making the textile yarns (14) travel continuously in front of said application stations (15*a*, 15*b*, 15*c*), each application station comprising a dye-spraying turbine (T1, T2, T3) driven rotationally by a drive motor (M1, M2, M3) about an axis which is parallel to the direction of travel of the yarns (14), each turbine having at its periphery several holes (16) for the passage of the dye which are suitable for spraying a succession of spots ($A_1$, . . . $B_1$, . . . $C_1$, . . . ) onto the yarns (14), the succession of application stations (15*a*, 15*b*, 15*c*) being adapted to form on each yarn a pattern of spots extending over a certain length (L) of the yarn (14) and which is continually repeated, wherein the application stations (15*a*, 15*b*, 15*c*) comprise means for individually adjusting the rotational speed (N) of the drive motor (M1, M2, M3) of each dye-spraying turbine (T1, T2, T3) and independently of that of the other motors in order to corrupt the repetitiveness of the successive patterns, wherein said means for adjusting the speed (N) are suitable for varying the length (L) of the successive patterns, so that, in a series of successive patterns, their length varies continuously up to + or −20% of their mean length ($L_m$).

16. The machine as claimed in claim 15, wherein said means for adjusting the speed (N) are further suitable for maintaining a certain offset between the rotational speeds of the turbines (T1, T2, T3) provided in the successive application stations.

17. The machine as claimed in claim 15, wherein said means for adjusting the speed (N) are suitable for accelerating or decelerating the rotational speed of a turbine (T1, T2, T3) of a given station so as to modify the order of the colors of the spots in the successive patterns.

18. The machine as claimed in claim 15, wherein each turbine (T1) is associated with a command means for stopping or starting the spraying of spots onto the yarns (14).

19. The machine as claimed in claim 18, wherein said means are suitable for forming successive patterns which are different from one another owing to the presence or absence of a spot of given color.

20. The machine as claimed in claim 15, wherein the motors (M1, M2, M3) for driving the turbines (T1, T2, T3) are brushless electric motors commanded by an electronic circuit controlled by a computer (P) suitable for varying their rotational speed according to a predetermined program.

* * * * *